US006871462B2

(12) United States Patent
Azizinamini

(10) Patent No.: US 6,871,462 B2
(45) Date of Patent: Mar. 29, 2005

(54) COMPOSITE ACTION SYSTEM AND METHOD

(75) Inventor: Atorod Azizinamini, Lincoln, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 0 days.

(21) Appl. No.: 10/191,150

(22) Filed: Jul. 9, 2002

(65) Prior Publication Data

US 2003/0115815 A1 Jun. 26, 2003

Related U.S. Application Data

(60) Provisional application No. 60/304,024, filed on Jul. 9, 2001.

(51) Int. Cl.[7] ..... E04B 1/16; E04B 1/20; E04B 5/18

(52) U.S. Cl. ..... 52/334; 52/432; 52/677; 52/338; 52/333; 52/435; 52/682; 52/649.1

(58) Field of Search ..... 52/334, 432, 677, 52/338, 341, 335, 333, 435, 682, 649.1, 342

(56) References Cited

U.S. PATENT DOCUMENTS 1,561,126 A * 11/1925 Timm ..... 52/254
1,576,482 A * 3/1926 Lein ..... 52/338
1,974,730 A * 9/1934 Zollinger ..... 52/334
3,564,799 A * 2/1971 Hanson ..... 52/334
3,778,947 A * 12/1973 Sauer ..... 52/232
4,037,375 A * 7/1977 Maggos et al. ..... 52/220.3
4,700,519 A * 10/1987 Person et al. ..... 52/334
5,664,378 A * 9/1997 Bettigole et al. ..... 52/414
5,809,722 A * 9/1998 Bertsche ..... 52/334

OTHER PUBLICATIONS

Pub. No.: GB 2,053,308 A Feb. 1981 Rober Templeman Cole.*

* cited by examiner

*Primary Examiner*—Carl D. Friedman
*Assistant Examiner*—Nahid Amiri
(74) *Attorney, Agent, or Firm*—Shook, Hardy & Bacon L.L.P.

(57) ABSTRACT

The present invention provides a composite action system and a method for fabricating the same to meet OSHA safety requirements and allow for welding off the work site. An improved structural system achieves the desired composite behavior by providing one or more structural members, plates coupled with the structural members, transverse reinforcing members passing through apertures in the plates, and additional reinforcing members positioned parallel and transverse to the structural members to provide an interlocking composite action between the structural members, reinforcing members, and concrete.

19 Claims, 1 Drawing Sheet

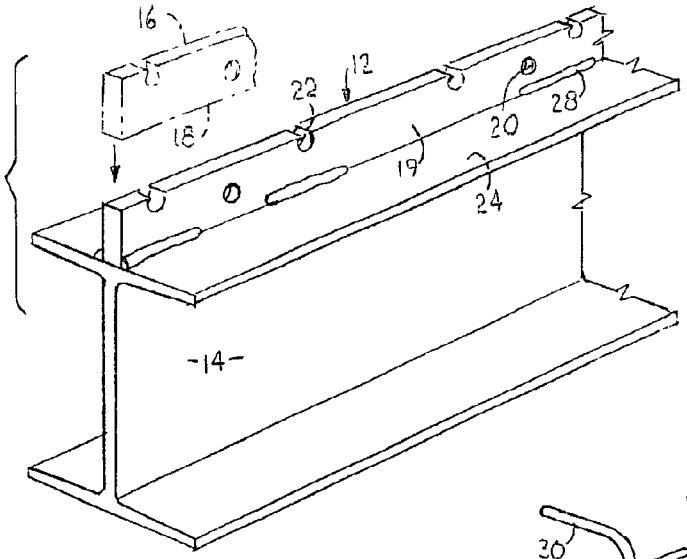
FIG. 1.
FIG. 3.
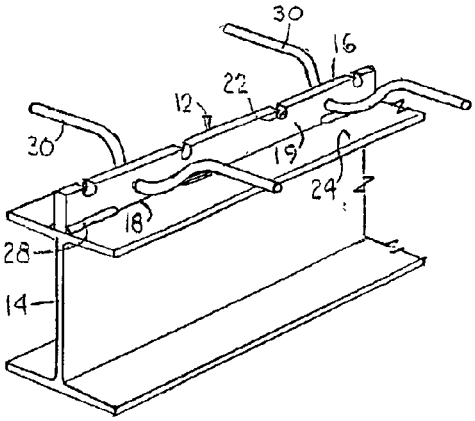
FIG. 4.
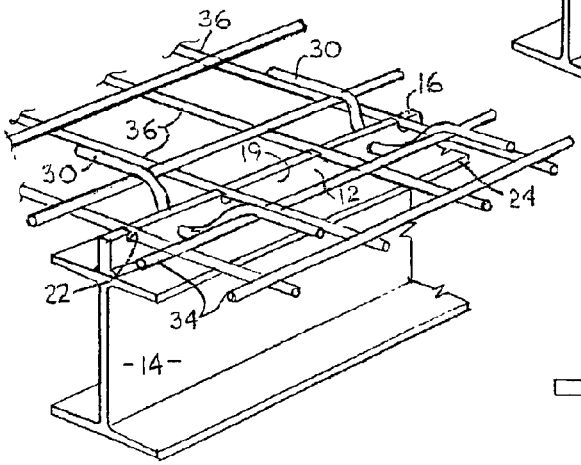
FIG. 2.
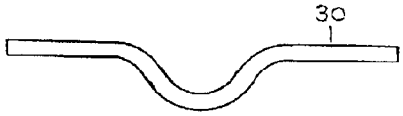
FIG. 5.
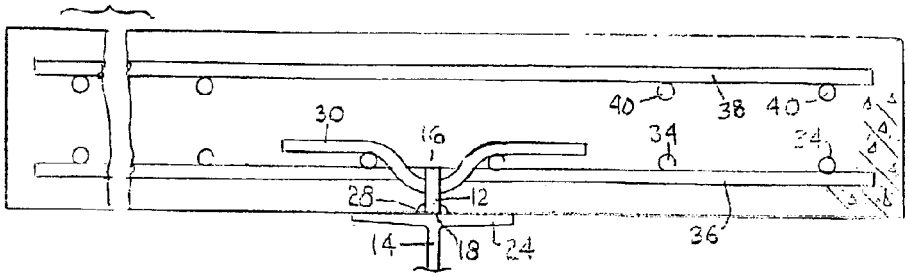

COMPOSITE ACTION SYSTEM AND METHOD

CROSS-REFERENCE TO RELATED APPLICATIONS

This application claims the benefit of Provisional Application No. 60/304,024, filed Jul. 9, 2001.

STATEMENT REGARDING FEDERALLY SPONSORED RESEARCH OR DEVELOPMENT

Not applicable.

BACKGROUND OF THE INVENTION

The present invention relates to structural support systems, such as those used in buildings and bridges. More specifically, the invention relates to a structural support system designed to achieve composite action and meet OSHA safety regulations.

As of Jul. 15, 2001, safety regulations imposed by OSHA on the steel structure and bridge industry have forced the industry to make a dramatic change. The required change deals with the way in which structural support systems are constructed. Structural members, such as composite steel beams and plate girders, are the main load-carrying members in structural support systems. The structural members are usually placed on supports, and a concrete slab is then cast on top of them. In nearly all cases, mechanical connectors are provided so that the structural members act in conjunction with the concrete in resisting applied loads. Such a result is commonly referred to as the steel-concrete composite action of the system.

The current practice of developing the composite action between the structural members and the concrete is to weld a shear stud or transversely placed plate or channel to the top of the structural member. There have also been suggestions of developing the composite action by placing a discontinuous plate along the beam length with large holes in the plate. All of these alternatives may be hazardous, as explained below, and do not pass OSHA safety requirements.

The typical construction sequence of the prior art involved welding shear studs to structural members in the shop, transporting the structural members to the field, and placing them on supports. The shear studs were welded to the top flange of each beam such that the studs extended upward from the flange. After the structural members were placed on the supports, workers walked on the top surface of the structural members (between the shear studs), placing formwork (a temporary support for wet concrete) between adjacent structural members. The concrete was then poured over the structural members and formwork.

A safety concern exists for workers required to walk on the top surface of the structural members. Workers may easily trip on the shop-welded shear studs, because of the limited space available for walking, and be severely injured or killed. This is the primary rationale for OSHA's mandate that shear studs be welded while in the field. Although this mandate may solve the problem of workers tripping on shop-welded shear studs, the industry is hesitant to weld in the field. Field welding is expensive and, in general, is of a lower quality than welding produced in the shop. The preference, therefore, is to do all welding in the shop before the structural members are shipped to the field.

In order to overcome these disadvantages, a method and apparatus for reinforcing concrete structures is needed that will meet OSHA safety requirements and allow for welding to be done in the shop.

SUMMARY OF THE INVENTION

The composite action system of the present invention, and the method for fabricating the same, provide a structural support system that achieves composite behavior. The system generally includes a plate welded to the upper flange of a structural member and at least one reinforcement member passing through an aperture in the plate.

In one embodiment, the composite action structural support system generally comprises a steel beam having an upper flange, a plate coupled with the upper flange of the beam, an aperture in the plate, and a recess in the upper surface of the plate. The structural support system in this embodiment further comprises a generally U-shaped or V-shaped reinforcing member passing through an aperture in the plate, a transverse reinforcing member placed within a recess formed in the upper edge of the plate, and a parallel reinforcing member intertwined with the U-or V-shaped reinforcing member and transverse reinforcing member. A method of fabricating the composite action structural support system is also disclosed herein.

BRIEF DESCRIPTION OF THE SEVERAL VIEWS OF THE DRAWINGS

FIG. 1 is a perspective view of a structural member having a plate coupled via non-continuous welding with the upper flange of the member.

FIG. 2 is a detailed elevation view of a generally U-shaped or V-shaped reinforcing member.

FIG. 3 is a perspective view of a structural member and plate with reinforcing members passing through apertures in the plate.

FIG. 4 is a perspective view of a structural member and plate with reinforcing members passing through apertures in the plate, transverse reinforcing members resting in recesses formed in the upper edge of the plate, and parallel reinforcing members intertwined with the generally U- or V-shaped reinforcing members and transverse reinforcing members.

FIG. 5 is a cross-sectional view of the structural support system depicted in FIG. 4, showing the plate and reinforcing members embedded in concrete to create composite action.

DETAILED DESCRIPTION OF A PREFERRED EMBODIMENT

This invention provides a composite action structural support system and method for making the same. The structural support system is designed to allow for safe construction, meets OSHA safety requirements, and permits welding in the shop. The structural support system generally includes a continuous plate 12 welded to the top flange of a structural member 14 and includes reinforcing members 30 passing through apertures 20 in the plate 12.

As best seen in FIG. 1, the structural support system generally includes a structural member 14 having an upper flange 24. The structural member is typically a steel beam having an I-shaped cross section. It will be understood by one skilled in the art, however, that other suitably strong and rigid structural members having other suitable cross-sections may be used, provided such members have a suitable top surface with which a plate may be coupled, as discussed below. The length of the structural member 14 is, of course, dependent on the application for which that structural member 14 will be needed.

A plate 12 is coupled with the upper flange 24 of the structural member 14, as seen in FIG. 1. The length of the plate 12 is typically the same as the length of the structural member 14. The plate 12 is generally coupled with the structural member 14 via continuous or "spot" (non-continuous) welding. The plate 12 generally has a top surface 16, a lower surface 18, and sides 19.

In the embodiment of the invention depicted in FIGS. 1–5, the lower surface 18 of the plate 12 is coupled with the upper flange 24 of the structural member 14. As shown in FIG. 1, the plate 12 is preferably coupled with the structural member 14 along the length of the structural member 14 such that the plate 12 is centered on the upper flange 24 and the plate 12 runs parallel to the long axis of the structural member. Welds 28 may be placed along one or both sides of the plate 12. Preferably, the plate 12 is welded to the upper flange 24 of the structural member 14 prior to locating the structural member 14 at the building site, due to the preference for shop welding as opposed to welding done in the field.

Apertures 20 are formed, as by drilling or torching, in the sides 19 of the plate 12. The plate 12 generally has multiple apertures 20 placed at some interval along the sides 19 of the plate 12. Reinforcing members are placed through these apertures 20, as discussed below. The plate 12 may also have recesses 22 formed in the top surface 16 of the plate 12 and placed at some interval along the top surface 16 of the plate 12. Additional reinforcing members may be placed in these recesses, as discussed below, to further enhance the composite action of the system.

FIG. 2 depicts a reinforcing member 30. The reinforcing members 30 can be of any length, depending upon the application for which they will be used. As seen in FIG. 2, the reinforcing member 30 is generally U-shaped or V-shaped and may be formed by bending a reinforcing bar to create a U-shaped or V-shaped "dip" at the midpoint of the member 30.

As shown in FIG. 3, the reinforcing member 30 is passed through an aperture 20 in the plate 12. The reinforcing member 30 is transverse to the plate 12 and structural member 14. Each reinforcing member 30 is passed through the aperture 20 and positioned such that the lowermost portion of the "dip" at the midpoint of the reinforcing member 30 is positioned within the aperture 20 in the plate 12. Concrete may then be poured such that the plate 12 and the reinforcing members 30 are embedded in the concrete to create composite action between the structural members 14 and the concrete. Generally, however, additional composite action is desired, and may be achieved by the placement of additional reinforcing members, as described below.

As best shown in FIG. 4, transverse reinforcing members 36 can be placed within the recesses 22 of the plate 12. The transverse reinforcing members 36 are generally steel rods or bars and are placed parallel to the reinforcing members 30 and transverse to the plate 12 and structural member 14. Each recess 22 receives one transverse reinforcing member 36.

As shown in FIG. 4, at least one parallel reinforcing member 34 may be intertwined with the transverse reinforcing members 36. The parallel reinforcing members 34 are placed in a direction parallel to the plate 12 and structural member 14 and transverse to the reinforcing members 30. The parallel reinforcing members 34 are placed by sliding the members 34 along and over the transverse reinforcing members 36 and may also be positioned under the reinforcing members 30 to "intertwine" the reinforcing members and optimize the action between the reinforcing members 30, the parallel reinforcing members 34, and the transverse reinforcing members 36 (see FIGS. 4 and 5). The parallel reinforcing members 34 may be placed at an appropriate interval along the reinforcing members 30 and/or the transverse reinforcing members 36. Reinforcing members 30 may be shorter than the transverse reinforcing members 36 (as depicted in FIG. 5) or may be the same length as transverse reinforcing members 36. It will be understood that the lengths of reinforcing members 30, transverse reinforcing members 36, and parallel reinforcing members 34 may be varied according to the application and desired composite action.

The reinforcing members 30, the transverse reinforcing members 36, and the parallel reinforcing members 34 may be fastened, generally by wire, welding, or other fastening means, at points where any two or more members intersect to increase stability of the system and improve the composite action. For example, the parallel reinforcing members 34 may be fastened to the reinforcing members 30 at points where they intersect, and the parallel reinforcing members 34 may be fastened to the transverse reinforcing members 36 at points where they intersect. As depicted in FIG. 5, additional transverse reinforcing members 38 and additional parallel reinforcing members 40 can be placed above the structural members 14 for additional concrete reinforcement.

Generally, a number of structural members 14 placed adjacent and parallel to one another (not depicted) are coupled together via reinforcing members 30, 34, and 36 to form an appropriate framework for the building or bridge being built. Formwork is typically placed between adjacent structural members prior to pouring of the concrete; this formwork is the temporary support for the wet concrete that is to be poured after the reinforcing members are placed. The reinforcing members 30, 34, and 36 are placed after the workers have positioned the structural members 14 and the formwork, and the reinforcing members 30 are fastened to transverse reinforcing members 36 and parallel reinforcing members 34 before casting the concrete. The concrete is poured such that the plates 12 and reinforcing members 30, 34, and 36 are encased in concrete to provide the requisite composite action between the structural steel components and the concrete.

This method of using plates 12 and reinforcing members 30, 34, and 36 to build a composite action structural support system provides a safe means of constructing a strong and rigid structural system and allows welding to be performed in the shop, thus providing the highest quality weld available.

It will be seen from the foregoing that this invention is one well adapted to attain the ends and objects set forth above, and to attain other advantages which are obvious and inherent in the product and method. It will be understood that certain features and subcombinations are of utility and may be employed without reference to other features and subcombinations. This is contemplated by and within the scope of the invention. It will be appreciated by persons skilled in the art that the product and method of the present invention are not limited to what has been particularly shown and described hereinabove. Rather, all matter herein set forth is to be interpreted as illustrative and not limiting.

I claim:

1. A structural system for the creation of composite action with concrete, comprising:

a structural member having an upper surface;

a plate coupled with said upper surface, said plate positioned generally parallel to said structural member, said plate defining an aperture; and a first reinforcing member having one or more vertically disposed recesses; the first reinforcing member passing through said aperture and positioned generally transverse to said structural member.

2. The system of claim 1, wherein said structural member is a steel beam.

3. The system of claim 1, wherein said plate is welded to said upper surface.

4. The system of claim 1, said first reinforcing member having a generally V-shaped portion.

5. The system of claim 1, said plate defining a recess in an upper surface of said plate.

6. The system of claim 5, said recess receiving a generally transverse reinforcing member.

7. The system of claim 6, further comprising a generally parallel reinforcing member positioned above said generally transverse reinforcing member.

8. The system of claim 7, said generally parallel reinforcing member positioned beneath said first reinforcing member.

9. The system of claim 8, further comprising a first fastener, said fastener coupling said generally parallel reinforcing member with said first reinforcing member, and a second fastener, said second fastener coupling said generally parallel reinforcing member with said generally transverse reinforcing member.

10. A structural system for the creation of composite action with concrete, comprising:

a first structural member having an upper surface;

a first plate coupled with said upper surface of said first structural member, said first plate defining a first aperture;

a second structural member having an upper surface, said second structural member positioned adjacent and generally parallel to said first structural member;

a second plate coupled with said upper surface of said second structural member, said second plate positioned generally parallel to said second structural member, said second plate defining a second aperture; and a first reinforcing member having one or more vertically disposed recesses; the first reinforcing member passing through said first aperture and said second aperture, said first reinforcing member spanning the distance between said first plate and said second plate and positioned generally transverse to said first structural member and said second structural member.

11. The structural system of claim 10, said first plate defining a first recess in an upper surface of said plate, said second plate defining a second recess in an upper surface of said second plate, said first recess and said second recess receiving a generally transverse reinforcing member.

12. The structural system of claim 11, further comprising a generally parallel reinforcing member positioned above said generally transverse reinforcing member.

13. The structural system of claim 12, said generally parallel reinforcing member positioned beneath said first reinforcing member.

14. The structural system of claim 13, further comprising a fastener, said fastener coupling said generally parallel reinforcing member with said first reinforcing member, and a second fastener, said second fastener coupling said generally parallel reinforcing member with said generally transverse reinforcing member.

15. A structural system for the creation of composite action with concrete, comprising:

a structural member having an upper surface;

a plate coupled with said upper surface, said plate positioned generally parallel to said structural member, said plate defining an aperture, said plate defining a recess in an upper surface of said plate;

a first reinforcing member passing through said aperture and positioned generally transverse to said structural member; and one or more parallel reinforcing members positioned beneath said first reinforcing member.

16. The system of claim 15, said first reinforcing member having a generally V-shaped portion.

17. The system of claim 15, said recess receiving a generally transverse reinforcing member.

18. The system of claim 17, further comprising a generally parallel reinforcing member positioned above said generally transverse reinforcing member.

19. The system of claim 18, further comprising a first fastener, said fastener coupling said generally parallel reinforcing member with said first reinforcing member, and a second fastener, said second fastener coupling said generally parallel reinforcing member with said generally transverse reinforcing member.

* * * * *